US007191621B2

(12) United States Patent
Zheng

(10) Patent No.: US 7,191,621 B2
(45) Date of Patent: Mar. 20, 2007

(54) MESH BAG

(76) Inventor: Shiyuan Zheng, No. 27, Xinpuyan Village, Yuanpu Town, Hangzhou City, Zhejiang Province (CN) 310024

( * ) Notice: Subject to any disclaimer, the term of this patent is extended or adjusted under 35 U.S.C. 154(b) by 0 days.

(21) Appl. No.: 11/411,180

(22) Filed: Apr. 26, 2006

(65) Prior Publication Data

US 2006/0185400 A1 Aug. 24, 2006

Related U.S. Application Data

(63) Continuation of application No. PCT/CN94/001212, filed on Oct. 25, 2004.

(30) Foreign Application Priority Data

Oct. 26, 2003 (CN) ..... 2003 2 0109357

(51) Int. Cl.
*D04B 1/22* (2006.01)

(52) U.S. Cl. ..... 66/170

(58) Field of Classification Search ..... 66/195, 66/202, 170, 169 R
See application file for complete search history.

(56) References Cited

U.S. PATENT DOCUMENTS 2,263,787 A * 11/1941 Safferson ..... 66/170
2,992,550 A * 7/1961 Frith, Jr. ..... 66/195
3,118,294 A * 1/1964 Laethem ..... 66/193
3,331,221 A * 7/1967 Lawson ..... 66/170
3,906,753 A * 9/1975 Siegfried ..... 66/170
4,785,613 A * 11/1988 Rhode ..... 66/195
4,989,995 A * 2/1991 Rubenstein et al. ..... 383/117
5,082,466 A * 1/1992 Rubenstein et al. ..... 8/142
5,638,703 A * 6/1997 Callaway ..... 66/195

FOREIGN PATENT DOCUMENTS

| | | |
|---|---|---|
| CN | 1089673 | 7/1994 |
| CN | 2437729 | 7/2001 |
| CN | 1328607 | 12/2001 |
| JP | 2000-1828 | 1/2000 |
| JP | 2001-123428 | 5/2001 |

* cited by examiner

*Primary Examiner*—Danny Worrell
(74) *Attorney, Agent, or Firm*—Jacobson Holman PLLC

(57) ABSTRACT

A mesh bag including warp and weft thread groups and a closing part, wherein the warp groups are arranged crosswise, and the weft groups are laid out intersecting with the warp groups, starting from the junctions of the warp group, the warp group goes through the perforation of weft loop, the knitting threads of the warp groups go through the outermost weft loop and then are knitted crosswise to form the mesh hole, and the closing part is formed through mesh holes being closed at the terminal end. The entire warp thread is knitted throughout the mesh bag, which can solve the existing technical problem that the mesh thread bears uneven stress so as to allow the stress on the entire warp thread to be distributed equally and therefore to increase the loading capacity of the mesh bag.

27 Claims, 4 Drawing Sheets

MESH BAG

This is a continuation of PCT/CN94/001212 filed Oct. 25, 2004 and published in Chinese.

FIELD OF THE INVENTION

This invention refers to a kind of mesh bag, especially a mesh bag that is knitted with knitting threads.

DESCRIPTION OF THE RELATED ART

At present, some kinds of mesh bags are made through a process, in which the ends of the knitting threads are wound on a bottom ring and then the threads are knitted outwards from the bottom ring. The bottom ring of the mesh bag is a weak link when the bag carries a heavy load. Because of concentrated stress, the knitting thread connected to the ring is likely to be broken. Some warp threads of the mesh bag are not entwined with each other, which makes the adjacent warp threads slide relative to each other to form gaps and goods in the bag are likely to slip out through the gaps. The tight knot method has been adapted to resolve the warp thread sliding problem at the warp side. However, the tight knot structure causes the warp threads to bear uneven stresses, which reduce the mechanical properties of the material. In addition, because each warp thread is located between the outer closing part and the bottom closing part, the warp thread bears uneven stress locally, so that the warp thread is unable to eventually bear the load and has less flexibility. As a result, the mesh bag is likely to be broken when carrying goods of a certain amount of weight.

SUMMARY OF THE INVENTION

A new kind of mesh bag is hereby provided to improve the existing technology, wherein the adjacent warp threads are unlikely to slip and stresses are distributed uniformly. For this purpose, this invention adopts the following technical features:

A kind of mesh bag, including a plurality of warp groups, each group being composed of one or more strands of warp threads; one or more weft loops; and a closing part, is characterized in that: the warp groups are arranged to intersect each other to form intersections, and the weft loops are laid out from the intersections outwards towards the closing part to intersect the warp groups along the length of the warp groups to divide the warp groups into sections; the warp groups go through different perforations of weft loops, the single- or multi-strand warp threads go through the perforations of the outermost weft loop and then are knitted crosswise to form the terminal mesh holes, and the adjacent warp threads are combined or entwined with each other to form the terminal mesh holes, which form the closing part, the ends of the warp threads being fixed on the warp sides of the terminal mesh holes.

Each of the aforesaid weft loops is composed of one strand of knitting thread. The weft thread is wound two circles in the weftwise direction to form the weft perforations.

The aforesaid mesh bag is further characterized in that: there are two warp threads on each warp side of the adjacent terminal mesh hole, one warp thread on the warp side is entwined with one warp thread of the adjacent warp side; and the other warp thread is entwined with one warp thread of another adjacent warp side so as to form another adjacent terminal mesh hole.

The aforesaid mesh bag is further characterized in that: after forming the terminal mesh hole, the ends of the warp threads go through the mesh hole that is next to the terminal mesh hole and go back to be fixed on the warp sides of the terminal mesh hole.

The previously mentioned mesh bag is further characterized in that: each terminal mesh hole is formed through all the warp threads of a pair of adjacent warp sides being entwined.

The aforesaid mesh bag is further characterized in that: there is at least one mesh hole whose side's multi-strand warp threads are knitted crosswise with the adjacent warp threads to form the mesh hole with each warp side of multi-strand knitting threads.

The aforesaid mesh bag is further characterized in that: there is at least one mesh hole, one of whose side's multi-strand warp threads is knitted crosswise with an adjacent warp thread, and another is not knitted with other warp threads.

The aforesaid mesh bag is further characterized in that: the warp knitting structure is as follows: the adjacent warp threads are entwined together to form a warp side of the mesh hole, at the end of the warp side, two outward outspreading warp threads are separated from each other to be entwined again with adjacent warp threads. The aforesaid mesh bag is further characterized in that the warp thread groups are arranged to form the shape of a hexagon.

The aforesaid mesh bag is further characterized in that: a reinforcement warp group goes through the opposite sides to the junction of the hexagon formed by the warp thread group.

The aforesaid mesh bag is further characterized in that: a reinforcing warp group goes through the diagonal position of hexagon formed by the warp thread group.

The aforesaid mesh bag is further characterized in that: a reinforcing weft group is entwined in the weftwise direction of the mesh hole.

The aforesaid mesh bag is further characterized in that: the warp group is composed of multi-strand knitting thread that each strand is able to be knitted separately.

The aforesaid mesh bag is further characterized in that: each of the warp groups has an equal number of knitting threads.

The aforesaid mesh bag is further characterized in that: the number of knitting thread of the reinforcing warp group is identical to that of the knitting threads of the warp group.

The aforesaid mesh bag is further characterized in that: the sizes of mesh holes are identical.

The aforesaid mesh bag is further characterized in that: starting from the weft loop, the size of the mesh holes change from small to large.

The aforesaid mesh bag is further characterized in that: starting from the weft loop, the size of the mesh holes change from large to small. The aforesaid mesh bag is further characterized in that: the warp group is composed of a single-strand knitting thread; after going through the weft loop perforations, respectively, the single-strand knitting threads are interlaced outward to form the mesh holes.

The aforesaid mesh bag is further characterized in that: the warp group is composed of double-strand knitting thread; after going through different perforations of the first weft loop, respectively, each warp group composed of double-strand knitting thread is then separated into two single-strand warp groups, then the single-strand warp groups go through different perforations of the second weft loop, and then are interlaced outward to form the mesh holes.

The aforesaid mesh bag is further characterized in that: the warp group is composed of three-strand knitting threads; after going through different perforations of the first weft loop, respectively, each warp group composed of three-strand knitting thread is then separated into two warp groups, respectively, composed of single and double-strand knitting threads, the single-strand knitting thread of which is combined with the adjacent single-strand knitting thread to form a double-strand warp group, which goes through a perforation of the second weft loop; the other double-strand warp group also goes through a perforation of the second weft loop.

The double-strand warp group going through the second weft loop is separated into single-strand warp threads, and the latter ones pass through different perforations of the third weft loop, and then are interlaced outward to form the mesh hole.

The aforesaid mesh bag is further characterized in that: the warp group is composed of four-strand knitting threads; each warp group composed of four-strand knitting thread goes through different perforations of the first weft loop, respectively, then is separated into two warp groups composed of double-strand knitting thread, and the two warp groups, respectively, go through different perforations of the second weft loop; the warp group going through the perforation of the second weft loop is separated into single-strand warp threads, which pass through different perforations of the third weft loop, and then are interlaced outward to form the mesh hole.

The aforesaid mesh bag is further characterized in that: the warp group is composed of five-strand warp threads; after the five warp threads consisting of each of such warp groups go through the different perforations of the first weft loop, respectively, these five-strand warp groups are re-grouped one by one in such a way as to be finally separated into the warp groups composed of three-strand warp threads:

The first five-strand warp group is re-grouped into a warp group composed of two- and three-strand warp threads; the second five-strand warp group adjacent to the first one is re-grouped into a warp group composed of single-, triple- and single-strand warp threads; the third five-strand warp group adjacent to the second five-strand warp group is re-grouped into a warp group composed of double- and three-strand warp threads; the two warp threads from the first five-strand warp group and the single warp thread from the second five-strand warp group constitute a warp group of three-strand warp threads, and so do another single warp thread from the second five-strand warp group and the two warp threads from the third five-strand warp group; and the above mentioned three-strand warp groups go through the different perforations of the second weft loop, respectively;

After passing through the different weft perforations of the third weft loop, respectively, the three-strand warp groups are re-grouped one by one in such a way as below to allow them to be divided into two-strand warp threads:

The two warp groups of single- and double-strands from the first three-strand warp group and the two warp groups of single- and double-strand warp groups from the three-strand warp group adjacent to the first warp group constitute a double-strand warp group, and so do the single-strand warp thread from the first warp group and the single-strand warp thread from the adjacent second three-strand warp group. After going through the different perforations of the third weft loop, respectively, the double-strand warp groups mentioned above are separated into single-strand warp threads, which then pass through the different perforations of the fourth weft loop, respectively, and then are interlaced outward to form the mesh holes.

The aforesaid mesh bag is further characterized in that: when the crosswise-arranged warp groups go through different weft loops, they are regrouped to form new groups. After they go through the perforations of the outermost weft loop, they are divided into warp groups of multiple-strand. The multiple-strand warp thread are interlaced outward to form the mesh holes with warp sides of multiple-strand.

The aforesaid mesh bag is further characterized in that: the ends of the warp and weft threads are bent to form round terminals; and there are thorn-proof nipples fixed on the ends of the warp and weft threads.

An entire warp thread is knitted throughout the mesh bag, which can solve the existing technical problem that the mesh thread bears uneven stress so as to allow any part of the entire warp thread to bear the force and make the stress distributed equally. As a result, the loading capacity of warp thread is increased and so is that of the mesh bag as a whole. By comparison with the mesh bag of the existing structure, under the conditions of the same number of warp threads and the same single warp thread, the mesh bag mentioned herein possesses a larger loading capacity.

By comparison with the mesh bag of the existing structure, to load goods with the same mass and size, the mesh bag mentioned herein can be made of less warp thread material.

Grouping of closing sides can make the mesh bag form an orifice like a petal. This kind of orifice can open more widely, as compared with the orifice of a whole loop, to allow the bag to accommodate goods of a larger size, which is suitable for vehicles to fill materials into such bags.

The crosswise shape of warp hexagon is stable. Adding reinforcement warp threads to the crosswise bottom of hexagon can raise the load capability of the mesh bag.

Multi-strand warp threads go through a series of weft perforations along its elongated direction to reduce the load on them. This also can effectively prevent the bottom warp thread from slipping. Accordingly, the stability of the perforation structure of the mesh bag is improved.

The mesh bag knitted with multi-strand warp threads has a larger carrying capacity. Comparing with a single warp thread of the equal size, a multi-strand warp thread has a lower knitting strength.

Because the warp and weft threads are all cut mechanically, forming of bent round ends or fixing of thorn-proof nipples on the ends of these threads can prevent them from hurting people when the bags are in use.

DETAILED DESCRIPTION OF THE INVENTION

EXAMPLE 1

Figure 3:
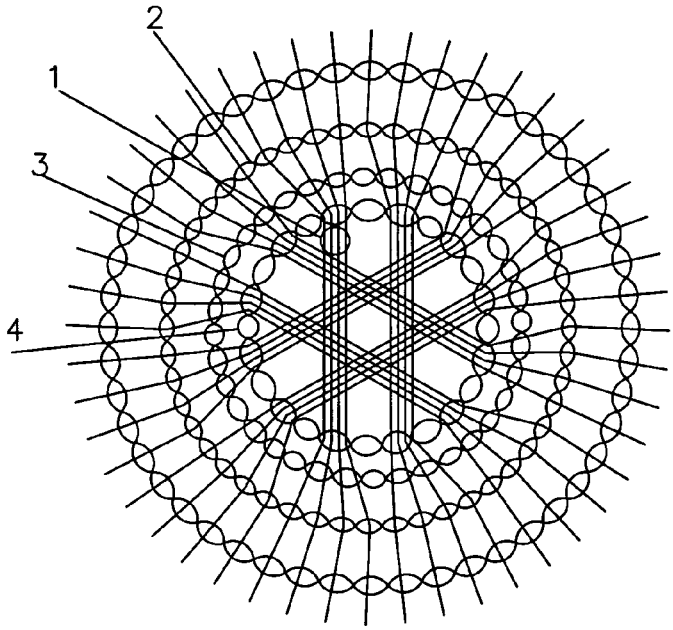
FIG. 3 is a schematic view of the bottom structure of the mesh bag with a four-strand warp groups according to the present invention.
Figure 4:
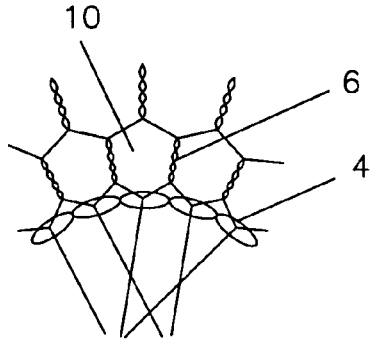
FIG. 4 is a partial schematic view of the structure of the mesh bag, where the warp thread of the mesh bag goes through the outermost weft loop according to the present invention.
Figure 5:
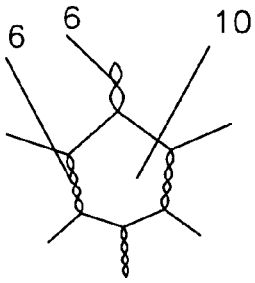
FIG. 5 is a partial schematic view of the mesh hole structure of this invention.
Figure 6:
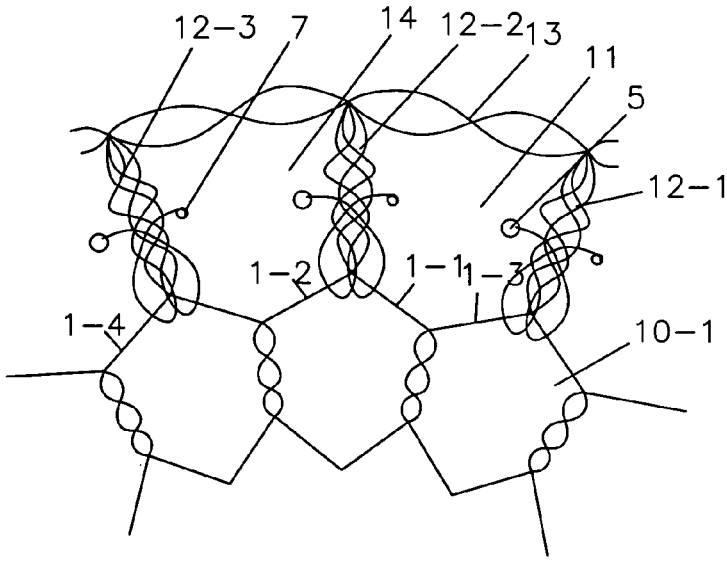
FIG. 6 is a schematic view of the closing structure of the adjacent terminal mesh holes of this invention.

A kind of mesh bag includes a plurality of warp groups 1, one or more weft groups and a closing part. The warp groups are arranged crosswise in the shape of a hexagon on the bag bottom. Starting from the junctions of the warp groups on the bag bottom, four weft loops 2, 3, 4 with sequentially increasing diameters are arranged one by one towards the distal ends of the warp groups, each of which is composed of a single knitting thread, and wound for two cycles in the weftwise direction so as to form weft perforations. The warp groups in this example are composed of single strand knitting threads, and the single strand warp groups sequentially go through the perforations of the weft loops and are then crosswise knitted to form mesh hole 10; As shown in FIGS. 3–4, the warp threads are knitted crosswise as follows: adjacent warp threads are entwined together to form a mesh hole warp side 6, then the entwined warp threads are separated from each other. The separated warp threads are further entwined with the adjacent warp threads to form new warp sides until they reach the closing part. As shown in FIG. 6, the closing part is formed through closure of the terminal mesh holes 11. Each terminal mesh hole contains two warp sides (12-1,12-2) and a tension-bearing side 13 at the exterior edge of the mesh bag. One aforementioned warp thread 1-1 and one warp thread of the adjacent warp side 1-3 are entwined to form the tension bearing side 13, which is used for bearing the hoisting tension when the bag is lifted. Then, the warp thread 1-1 is firstly entwined on the warp side 12-1 of the terminal mesh hole, then it goes through mesh hole 10-1, and reverses its direction to again entwine and fix itself on the warp side 12-1 to form the terminal mesh hole 11. Similarly, the other warp thread 1-2 and one warp thread 1-4 of the adjacent warp side are entwined in the same way to form an adjacent terminal mesh hole 14.

Nipples 5 are fixed onto the ends of warp and weft threads to prevent the knitting thread ends from hurting people.

After the warp thread is entwined to form a tension bearing side, the end of the warp thread can also be wound in several circles around the tension bearing side 13, the warp side of the terminal mesh hole and then fixed on the warp side of terminal mesh hole 11. The length of warp thread can be shortened in such kind of structure.

The present invention can be used as follows: after materials are placed into the mesh bag, a wirerope is inserted through terminal mesh holes 11 and 14, then the bag is hoisted to tighten the wirerope. Then a steel wire is used to run through the terminal mesh holes 11 and 14. After the two ends of the steel wire are connected, the steel wire closes the closing part of the bag. The bag can be lifted and moved to desirable location.

EXAMPLE 2

As shown in the drawing, the difference between this example and Example 1 is that: the warp group mentioned in this example is composed of double-strand knitting thread and they are arranged differently from the Example 1. More specifically, after going through different perforations of the first weft loop, respectively, each warp group composed of double-strand knitting thread is then separated into two single-strand warp groups. Then the single-strand warp threads go through different perforations of the second weft loop, and are interlaced to form the mesh holes. The warp side of the terminal mesh hole has two warp threads. Two adjacent terminal mesh holes form a closing group. The adjacent warp threads of each closing group are entwined with each other at the tension bearing side. Then, the warp terminal is entwined and hooked onto the warp side of mesh hole, and the hook end passes through the warp perforation of the warp side.

The terminal ends of warp and weft threads are bent to be form round ends 7 to prevent them from hurting people.

EXAMPLE 3

Figure 1:
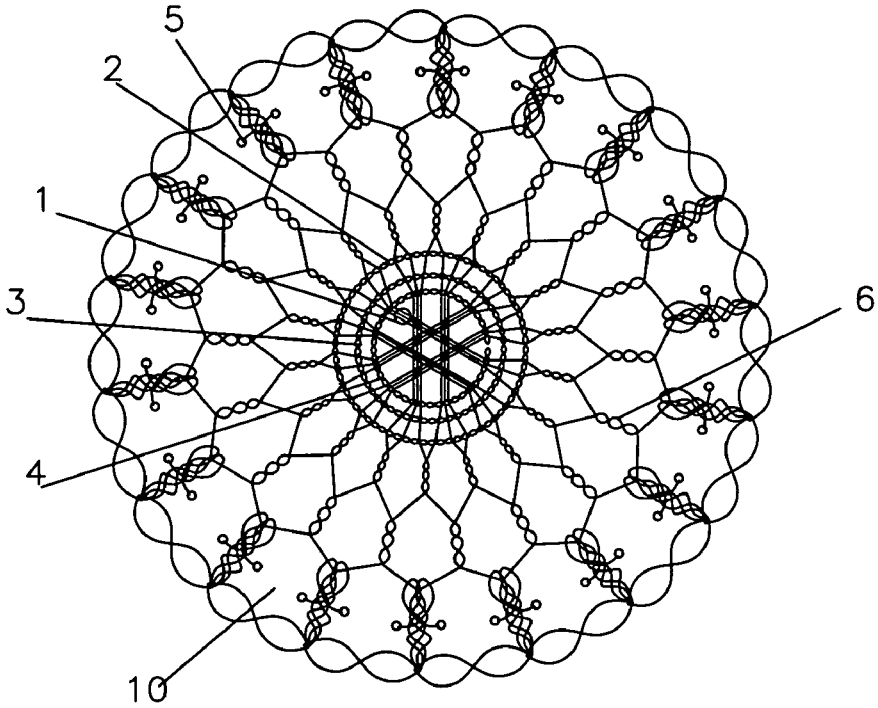
FIG. 1 is a schematic view of the overall structure of the mesh bag with three-strand warp groups according to the present invention.

As shown in FIG. 1, the difference between this example and Example 1 is that there are four weft loops in this example and the warp group mentioned in this example is composed of three-strand knitting threads. After going through different perforations of the first weft loop, respectively, each three-strand warp group is then divided into two warp groups, each including single- or double-strand knitting threads. The single-strand warp thread of the warp groups is combined with the adjacent single-strand knitting thread to form a double-strand warp group, which goes through the same perforation of the second weft loop. The other double-strand warp group also goes through the same perforation of the second weft loop.

After going through the second weft loop, the double-strand warp group is separated into single-strand warp threads, which pass through different perforations of the third weft loop, and then are interlaced to form the mesh holes.

EXAMPLE 4

As shown in FIG. 3 and being different from Example 1, the warp group mentioned in this example is composed of four-strand knitting thread. After going through different perforations of the first weft loop, respectively, each warp group composed of four-strand knitting thread is then separated into two double-strand warp groups. After going through different perforations of the second weft loop, the two double-strand warp groups are then divided into single-strand warp threads, which respectively go through different perforations of the third weft loop and then are interlaced to form the mesh holes.

EXAMPLE 5

Figure 2:
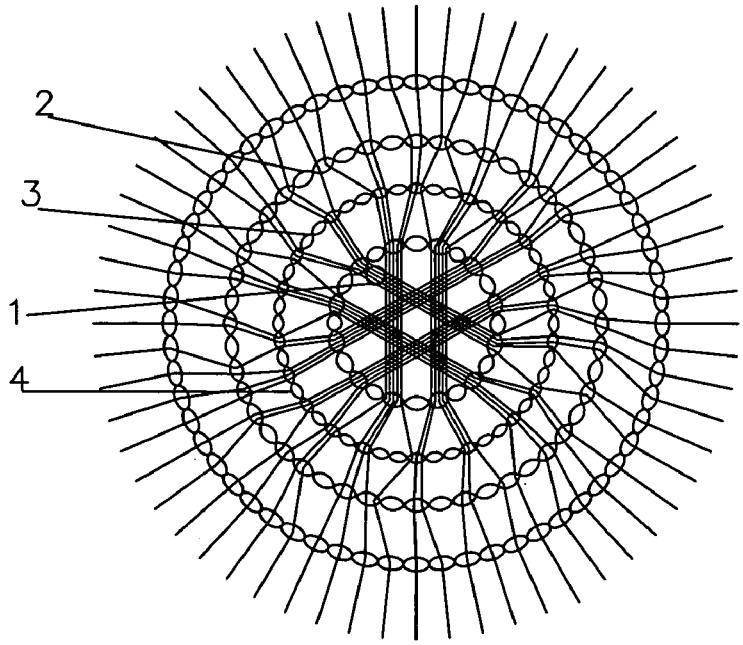
FIG. 2 is a schematic view of the bottom structure of the mesh bag with five-strand warp groups according to the present invention.

As shown in FIG. 2, the difference between this example and Example 1 is that the warp group mentioned in this example is composed of five-strand knitting thread and their arrangement is different from Example 1. More specifically, the warp threads of each warp group composed of five-strand knitting thread go through different perforations of the first weft loop, respectively, then the five-strand warp groups are re-grouped sequentially in such a way to be finally separated into the warp groups composed of three-strand knitting thread:

The first warp group composed of five-strand knitting thread is divided into two warp groups composed of two- and three-strand knitting threads. The adjacent second five-strand warp group is divided into three warp groups composed of two single-strand and one two-strand knitting threads. The third five-strand warp group adjacent to the second one is divided into two warp groups composed of two- and three-strand knitting threads. The two-strand knitting thread from the first five-strand warp group and the single-strand knitting thread from the second warp group form a warp group of three-strand knitting thread, and so do another warp thread of single-strand knitting thread from the second five-strand warp group and the two-strand warp thread from the third warp group. The above mentioned three-strand warp groups go through different perforations of the second weft loop, respectively;

After passing through different perforations of the third weft loop, respectively, the three-strand warp groups are re-grouped sequentially in such a way as below to allow them to be divided into the two-strand warp threads:

The first three-strand warp group is divided into a single- and a two-strand warp groups. The three-strand warp group adjacent to the first one is divided into a single- and a double-strand warp groups. The single-strand warp threads from the first warp group and the single-strand warp thread from the adjacent second three-strand warp group form a two-strand warp group. The above mentioned double-strand warp groups go through different perforations of the third weft loop, respectively.

After going through the third weft loop, the double-strand warp group is separated into single-strand warp threads, which pass through different perforations of the fourth weft loop, respectively, and then are interlaced outward to form the mesh holes.

EXAMPLE 6

The difference between this example and Example 5 is that the single-strand warp threads, mentioned in this example, go through the outermost weft perforations, and then go through different perforations of a weft loop, respectively.

Example 7

Figure 7:
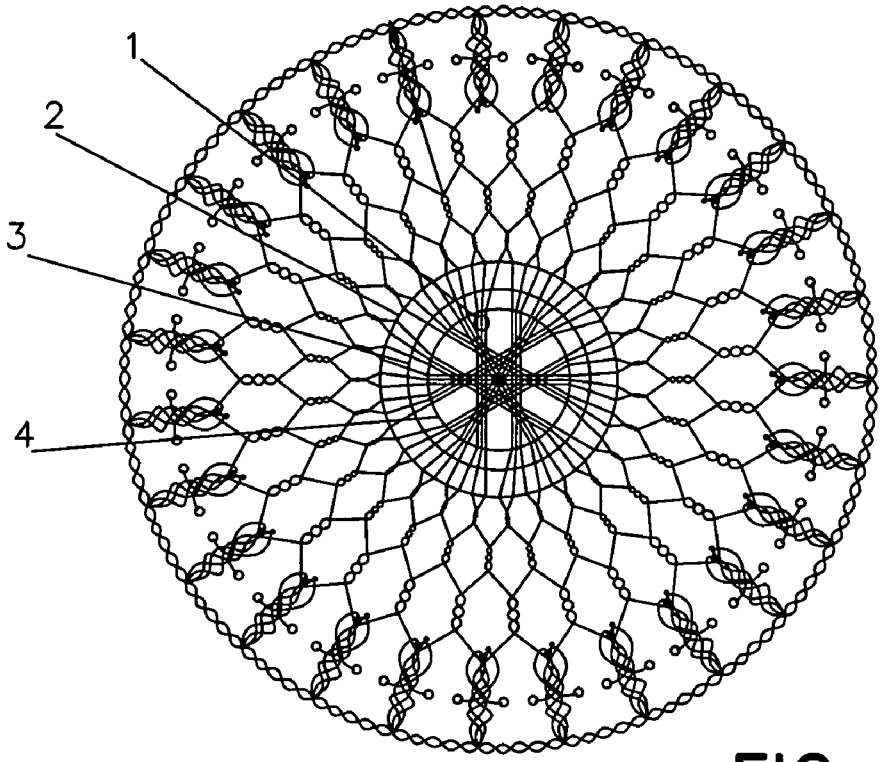
FIG. 7 is this invention's schematic view of the overall structure of three-strand warp groups with reinforcement warp thread going through the opposite sides of the hexagon formed by the warp groups.
Figure 8:
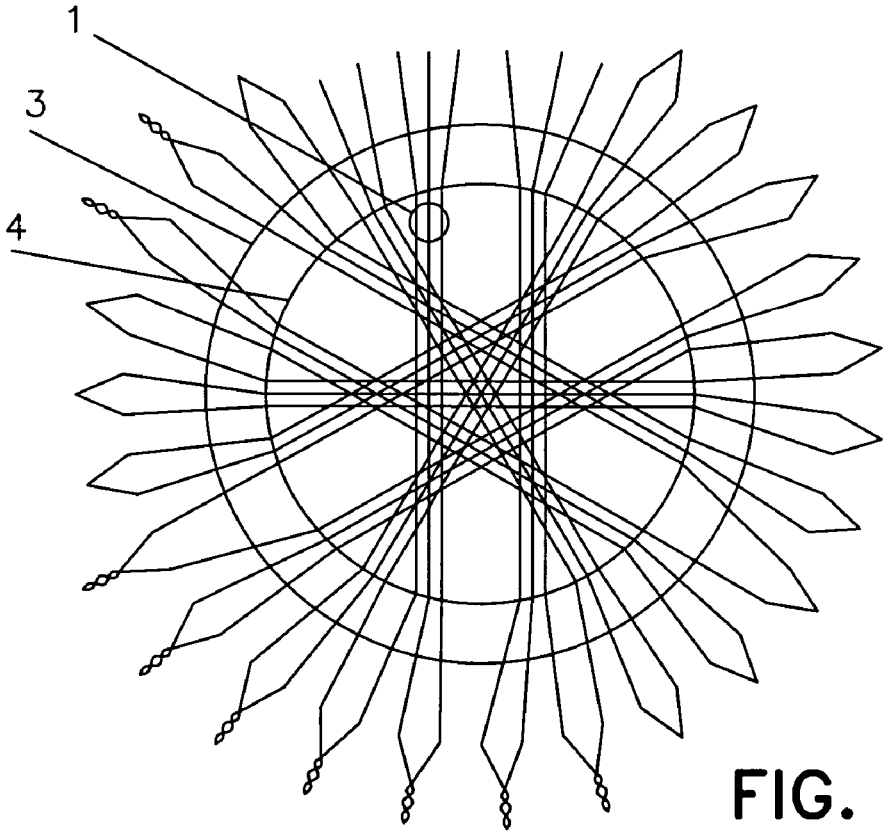
FIG. 8 is this invention's partial enlarged schematic view of the bottom structure of three-strand warp group with reinforcement warp thread going through the opposite sides.

As shown in FIGS. 7 and 8, different from Example 3, this example shows that the reinforcement warp groups go through the opposite sides of the hexagon formed by the warp groups on the bag bottom. The number of strands of the reinforcement warp groups is the same as the number of strands of other warp groups of the bag. The reinforcement weft threads are wound around the warp sides of the mesh holes at the same latitude of the third weft loop.

EXAMPLE 8

Figure 9:
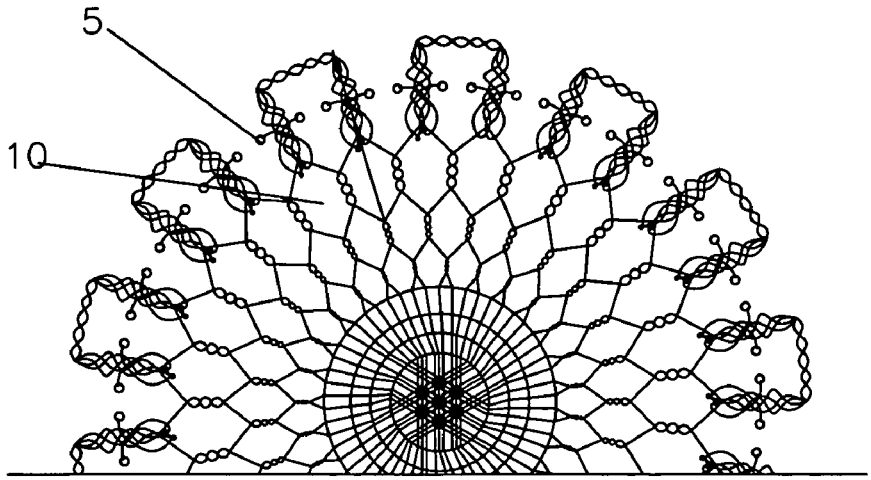
FIG. 9 is this invention's partial schematic view showing that there remains a gap between two adjacent terminal mesh holes of three-strand warp group.
Figure 10:
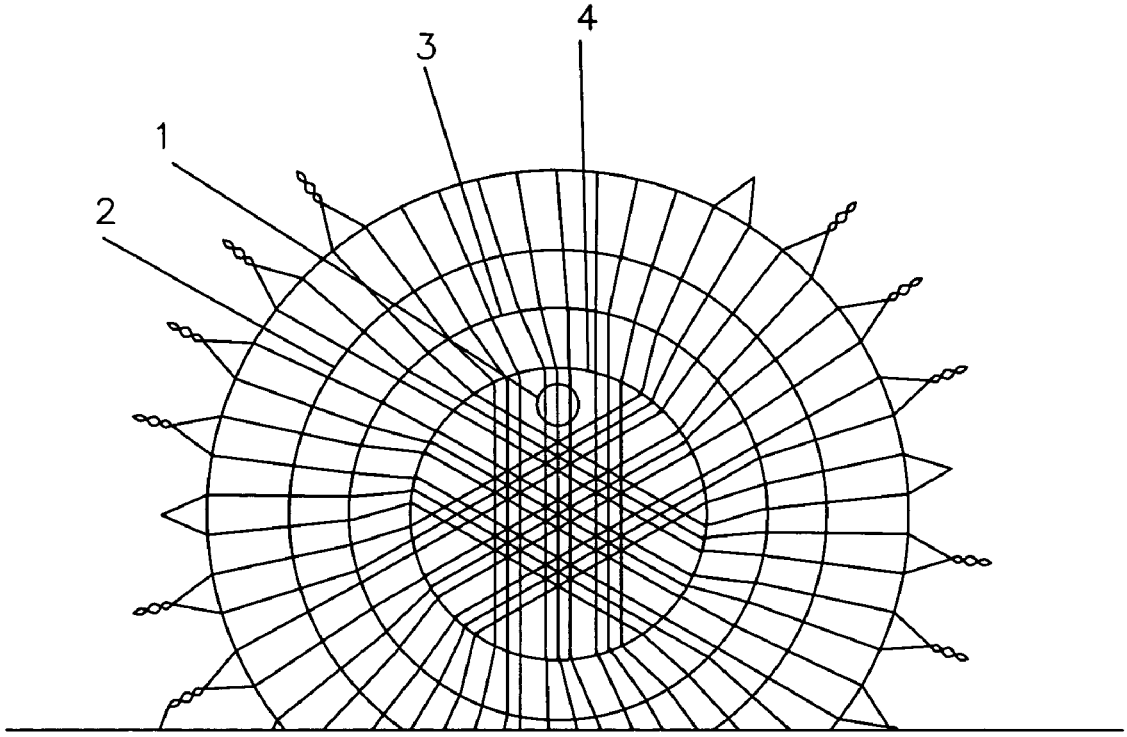
FIG. 10 is this invention's partial schematic view of the bag bottom of three-strand warp group with reinforcement warp threads going diagonally through the hexagon formed by the warp groups.

As shown in FIGS. 9 and 10, different from Example 7, this example shows that the reinforcement warp groups go diagonally through junctions of the hexagons formed by the warp groups on the bag bottom. In addition, each terminal mesh hole is formed through all the warp threads being entwined from opposite direction of a pair of adjacent warp sides. Thus, a gap is formed between the adjacent terminal mesh holes so that the mesh bag can be spread out and folded easily.

EXAMPLE 9

In this example, there are two different mesh holes at the same latitude of the mesh bag. The two-strand warp thread of the warp side of the mesh hole and the adjacent warp thread are interlaced to form the mesh hole with its single warp side of double-strand warp thread. The outspread warp side of the mesh hole is interlaced with the adjacent warp thread to form the mesh hole with single warp sides of three-strand warp thread, and continually done so until the terminal mesh holes are formed. Thus, two disjunctive pieces of mesh sheet are made to form a ringent bag opening, so that the bag that is filled with goods can be closed smoothly.

EXAMPLE 10

In this example, there are two different mesh holes at the same latitude of the mesh bag. The warp side has two-strand warp threads. One of them and the adjacent warp thread are interlaced to form the mesh hole. As mentioned above, only one two-strand warp thread of the warp side is used to be outspread and knitted, and the other warp thread is not knitted with any of other warp threads. Thus, two disjunctive mesh sheets are made and a ringent bag opening is formed. In addition, there are multiple warp threads stretching individually outward. When the mesh bag opening is being closed, these warp threads can be used to wind around the adjacent closing sides of the mesh sheets for connection.

EXAMPLE 11

The mesh bag mentioned in this example has mesh holes of the same size, which thereby form the mesh bag in the shape of barrel.

EXAMPLE 12

As regards the mesh bag mentioned in this example, its mesh holes change, starting from the weft thread, from small to large, presenting a plane network structure as shown in FIG. 1, which allows the closing part to be bundled centrally and goods to be filled.

EXAMPLE 13

In this example, its mesh holes sizes change, starting from the weft thread, from large to small to form an approximately a spherical shape mesh bag.

EXAMPLE 14

Different from Example 1, the warp groups of the mesh bag mentioned in this example consist of multi-strand knitting threads, which are interlaced, without being grouped, to form mesh holes. Thus, the mesh bag carrying capacity is increased.

Hexagonal crossing of warp groups at the bottom of the bag is not the only mode of crossing, but it is the stablest one. Certainly, triangular, quadrangle and other modes can also be adopted. However, these crossing modes shall be still regarded as those within the scope of this invention. It is allowable that the numbers of knitting threads constituting warp groups are greater than those disclosed above. In such a way, the warp groups with more knitting threads can effectively raise their bearing capacity to consequently increase the carrying capacity of the mesh bag as a whole. A knitting thread (rope) can also be made of multi-strand knitting threads. The mesh bag mentioned for this invention can be in the shapes of a flat plane, a barrel, a bowl, etc., in accordance with the different mesh hole sizes and arrangements. Among them, the flat mesh bag can be in the form of such polygons as triangle, quadrangle, etc., and can also be in the forms of circle, ellipse and other analogous circles. This invention can be employed at protective dike toes. For instance, the mesh bag can be filled with stones by hand or machine, and finally forms a stone carrying mesh bag after the bag opening is closed. Because the stone carrying mesh bag has a closing part, a mechanical arm can be used to hoist the bag at its closing part for transportation. These bags can be thrown into water by means of boat or other means to form protective belts for protective dike toes. The individual bags can also be connected with each other to establish a cluster of such bags, which is more effective for protection of dike toes.

What is claimed is:

1. A mesh bag comprising a plurality of warp groups consisting of single- or multi-strand warp threads, one or more weft loops and a closing part, characterized in that:

the warp groups are arranged to intersect each other to form intersections;

the weft loops are laid out from the intersections outwards towards the closing part to intersect the warp groups, wherein the warp groups go through different perforations of the weft loops;

the single- or multi-strand warp threads pass through an outermost weft loop via different perforations of the outermost weft loop and then are interlaced to form mesh holes;

the adjacent warp threads are combined or entwined with each other to form terminal mesh holes of the closing part;

ends of warp threads are fixed on warp sides of the terminal mesh holes.

2. The mesh bag according to claim 1, wherein each weft loop is made of one knitting thread, and the knitting thread is wound two circles the weftwise direction to form weft perforations.

3. The mesh bag according to claim 1, wherein there are two warp threads of each warp side of the adjacent terminal mesh holes, one warp thread of which is entwined with one warp thread of the adjacent warp side to form a terminal mesh hole; and the other warp thread of which is entwined with one warp thread of another adjacent warp side to form another adjacent terminal mesh hole.

4. The mesh bag according to claim 1, wherein said each terminal mesh hole is formed through all the warp threads of a pair of adjacent warp sides being entwined from opposite directions.

5. The mesh bag according to claim 3, wherein, after going through a mesh hole next to the terminal mesh hole, the warp thread terminal is fixed on the warp side.

6. The mesh bag according to claim 1, wherein there is at least one mesh hole whose side's multi-strand warp threads are knitted concurrently with the adjacent warp threads to form the mesh hole with a single side of multiple warp threads.

7. The mesh bag according to claim 1, wherein one of the multiple warp threads of at least one mesh hole is knitted with the adjacent warp thread and the other is not knitted with any other warp thread.

8. The mesh bag according to claim 1, characterized in that: the mesh holes are formed through the process wherein a part of adjacent warp threads are entwined with each other to form a warp side of a mesh hole, then the warp threads are separated and proceed toward the distal direction of the warp thread, until they are entwined again with other adjacent warp threads.

9. The mesh bag according to claim 1, wherein the warp thread groups are arranged crosswise in the form of a hexagon at the bottom of the bag.

10. The mesh bag according to claim 9, wherein one or more reinforcement warp threads go through the opposite sides of the hexagon.

11. The mesh bag according to claim 9, wherein one or more reinforcement warp threads go diagonally through the hexagon.

12. The mesh bag according to claim 9, wherein in the weftwise direction of the mesh, reinforcement weft thread groups are entwined with each other.

13. The mesh bag according to claim 1, wherein the warp groups are composed of multiple knitting threads, which can be knitted separately.

14. The mesh bag according to claim 13, wherein the warp groups have the same number of knitting threads.

15. The mesh bag according to claim 11, wherein the number of knitting threads of the reinforcing warp thread group is identical to that of the knitting threads of the warp thread group.

16. The mesh bag according to claim 1, wherein the mesh holes are equal in size.

17. The mesh bag according to claim 1, wherein starting from the last weft loop at the distal direction of the warp threads, the mesh holes size changes from small to large.

18. The mesh bag according to claim 1, wherein starting from the last weft loop at the distal direction of the warp threads, the mesh holes size changes from large to small.

19. The mesh bag according to claim 14, wherein when the crosswise arranged multiple-strand warp thread groups go through different weft loops, the threads are re-grouped to form new multiple-strand warp thread groups until the last weft loop, and the warp thread group is composed of a single-strand knitting thread, which is then interlaced with each other outward to form the mesh holes.

20. The mesh bag according to claim 19, wherein the warp thread group is composed of double-strand knitting thread; after going through different perforations of the first weft loop, respectively, each warp thread group composed of double strand knitting thread is then separated into two warp thread groups of single strand, then the single strand warp threads go through different perforations of the second weft loop, and then are further interlaced to form the mesh holes.

21. The mesh bag according to claim 19, wherein the warp thread group is composed of three-strand knitting thread; after going through different perforations of the first weft loop, respectively, each warp thread group composed of three strand knitting thread is then separated into two warp thread groups, respectively, composed of single- and double-strand knitting threads, the single-strand knitting thread of which is combined with an adjacent single strand knitting thread to form a double strand warp group going through one perforation of the second weft loop; the other double strand warp group also goes through one perforation of the second weft loop; and the double strand warp group going through the second weft loop is separated into single strand warp threads, and the single strand warp threads pass through the different weft perforations of the third weft loop, respectively, and then are interlaced outward to form the mesh holes.

22. The mesh bag according to claim 19, wherein the warp group is composed of four-strand knitting thread; after going through different perforations of the first weft loop, respectively, each four-strand warp group is then separated into two double-strand warp groups, which, respectively, go through the different perforations of the second weft loop and are then divided into single-strand warp threads, then these single-strand warp threads go through the different perforations of the third weft loop, respectively, and are then outward interlaced to form the mesh holes.

23. The mesh bag according to claim 19, wherein each warp thread group is composed of five-strand knitting thread; the warp threads of each of such groups go through the different perforations of the first weft loop, respectively, then such warp groups are re-grouped sequentially in such a way to be finally separated into the warp groups composed of three strand knitting thread:

the first warp group composed of five-strand knitting threads is divided into two warp groups composed of two- and three-strand knitting threads; the second five-strand warp group adjacent to the first one is divided into three warp groups composed of single-, triple- and single-strand knitting threads; the third five-strand warp group adjacent to the second one is divided into two warp groups composed of two- and three-strand knitting threads; the two-strand knitting thread from the first five-strand warp group and the single-strand knitting thread from the second one constitute a warp group of three-strand knitting thread, and so do another warp thread of single-strand knitting thread from the second five-strand warp group and the two-strand warp thread from the third one; and the warp groups of three-strand knitting threads go through the different perforations of the second weft loop, respectively;

after respectively passing through the different weft perforations of the third weft loop, the three-strand warp groups are regrouped sequentially in such a way as below to make them divided into two-strand warp threads:

the first three-strand warp thread group is divided into two warp groups of single- and two-strand knitting threads and so is the three-strand warp group adjacent to the first one, which is the second three-strand wrap thread group; the two single-strand warp groups, respectively, from the first and the second ones are grouped into two-strand warp groups, which then go through the different perforations of the third weft loop, respectively; and the double-strand warp group, after going through the third weft loop, is separated into single-strand warp threads, which pass through the different perforations of the fourth weft loop, respectively, and then are interlaced to form the mesh holes.

24. The mesh bag according to claim 20, wherein the single-strand strand warp threads go through the different perforations of the outermost weft loop and then pass through the different perforations of a weft loop, respectively.

25. The mesh bag according to claim 1, wherein when the crosswise arranged warp groups go through different weft loops, the knitting threads are re-grouped to constitute new warp groups, which are divided into multi-strand warp groups when going through the outermost weft loops; and these multi-strand warp threads are interlaced outward to form the mesh holes with multiple-strand sides.

26. The mesh bag according to claim 1, wherein the ends of the warp and the weft threads are bent to be round shape.

27. The mesh bag according to claim 1, wherein means for preventing ends of the warp and weft threads from hurting people are fixed on the ends of the warp and weft threads.

* * * * *